US011374298B1

(12) United States Patent
Wrigley

(10) Patent No.: US 11,374,298 B1
(45) Date of Patent: Jun. 28, 2022

(54) HYBRID-HARMONIC WAVEGUIDE FILTER INCLUDING CORRUGATIONS COUPLED BY RIDGE INTERCONNECTS AND HAVING SLOPED TRANSFORMER SECTIONS

(71) Applicant: LOCKHEED MARTIN CORPORATION, Bethesda, MD (US)

(72) Inventor: Jason Stewart Wrigley, Littleton, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 17/035,567

(22) Filed: Sep. 28, 2020

(51) Int. Cl.

| | |
|---|---|
| ***H01P 1/211*** | (2006.01) |
| ***H01P 11/00*** | (2006.01) |
| ***H01P 3/123*** | (2006.01) |
| ***H01P 1/212*** | (2006.01) |

(52) U.S. Cl.
CPC ..... *H01P 1/211* (2013.01); *H01P 1/212* (2013.01); *H01P 3/123* (2013.01); *H01P 11/002* (2013.01); *H01P 11/007* (2013.01)

(58) Field of Classification Search
CPC ..... H01P 1/211; H01P 1/212; H01P 11/007
USPC ..... 333/211
See application file for complete search history.

(56) References Cited

U.S. PATENT DOCUMENTS

| | | | | |
|---|---|---|---|---|
| 3,046,503 A * | 7/1962 | Cohn | H01P 1/211 | 333/210 |
| 3,597,710 A * | 8/1971 | Levy | H01P 1/211 | 333/210 |
| 3,819,900 A * | 6/1974 | Ironfield | H01P 1/16 | 219/750 |

* cited by examiner

*Primary Examiner* — Benny T Lee
(74) *Attorney, Agent, or Firm* — BakerHostetler

(57) ABSTRACT

A hybrid-harmonic waveguide filter includes transformer sections at end terminals of the harmonic waveguide filter, a number of corrugations along the length of the waveguide filter, and multiple ridge interconnects that couple the corrugations. By shaping the identical-cross-section ridge interconnects via single-pass wire electrical-discharge machining (EDM), low manufacturing cost is achieved along with continuous broadband rejection of TEn0 modes and an extremely high-power handling capability is observed.

19 Claims, 5 Drawing Sheets

HYBRID-HARMONIC WAVEGUIDE FILTER INCLUDING CORRUGATIONS COUPLED BY RIDGE INTERCONNECTS AND HAVING SLOPED TRANSFORMER SECTIONS

STATEMENT REGARDING FEDERALLY SPONSORED RESEARCH OR DEVELOPMENT

Not applicable.

FIELD OF THE INVENTION

The present invention generally relates to communication systems, more particularly to a high-power hybrid-harmonic filter.

BACKGROUND

Space programs commonly require a compact and high-power low-pass filter that can offer a broad passband and a broad continuous transverse electrical (TE)n 0 rejection band. The TEn0 modes, which are not launched when a waveguide filter's rejection is measured with long smooth tapers, can significantly disrupt the rejection band in the presence of TEn0 exciters such as h-plane bends. Existing solutions such as the traditional electroformed waffle iron filter offer the desired compact envelope and continuous broadband TEn0 rejection, however, have a high manufacturing cost, low manufacturing yield, due to residual post-etch aluminum, and a very low power handling capability. When manufactured as a split block to reduce fabrication cost, the waffle geometry must be split on the peak current region of the waveguide, which is also not desirable.

Low-pass filter techniques also exist which cascade different width waveguide sections and utilize standard corrugations (no waffle teeth) in order to suppress TEn0 modes. By selecting the waveguide widths such that TEn0 mode cutoffs position advantageously, broadband rejection can be achieved. However, these cascaded-style filters are very long, have high mass and do not achieve much better than 40 dB of TEn0 rejection in the presence of TEn0 exciters, such as h-plane bends, which very often exist in the next-level spacecraft assembly.

SUMMARY OF THE INVENTION

According to various aspects of the subject technology, a high-power hybrid-harmonic filter is provided that offers a broad passband and broad continuous rejection band even in the presence of TEn0 exciters. Additionally, the disclosed harmonic filter offers a low-cost ultrahigh multipaction threshold solution.

In one or more aspects, a hybrid-harmonic waveguide filter includes transformer sections at end terminals of the harmonic waveguide filter, a number of corrugations along the length of the waveguide filter, and multiple ridge interconnects that couple the corrugations. The ridge interconnects are shaped via wire electrical-discharge machining (EDM) making them a hybrid to the traditional waffle teeth, and offer a very high Multipaction threshold along with continuous broadband TEn0 rejection. As can be appreciated, lower manufacturing costs are achieved due to avoidance of the electroforming process, and the geometry may be split in a zero-current region of the waveguides.

In other aspects, a method of providing a hybrid-waveguide filter includes creating transformer sections by machining a first piece of conductor and creating a number of corrugations and multiple ridge interconnects coupling the corrugations. The transformer sections form the end terminals of the waveguide filter, and the corrugations are created along a length of the waveguide filter. The transformer sections, the corrugations and the ridge interconnects form a first half-section air cavity.

In yet other aspects, an apparatus includes two transformer sections at two ends of the apparatus. A number of corrugations are disposed along a length of the apparatus, and multiple ridge interconnects are disposed to couple the plurality of corrugations. Each ridge interconnect is a shaped hybrid-ridge interconnect created along a corrugation of the plurality of corrugations.

The foregoing has outlined rather broadly the features of the present disclosure so that the following detailed description can be better understood. Additional features and advantages of the disclosure, which form the subject of the claims, will be described hereinafter.

BRIEF DESCRIPTION OF THE DRAWINGS

For a more complete understanding of the present disclosure and the advantages thereof, reference is now made to the following descriptions to be taken in conjunction with the accompanying drawings describing specific aspects of the disclosure, wherein.

DETAILED DESCRIPTION OF THE INVENTION

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block-diagram form in order to avoid obscuring the concepts of the subject technology.

According to various aspects of the subject technology, a high-power harmonic filter is disclosed. The high-power harmonic filter of the subject technology is capable of providing a broad passband and broad continuous rejection band. The disclosed harmonic filter includes two main cavity shaped teeth and a half tooth on the outer wall which results in broadband rejection up to the third or fourth harmonic. However, more teeth may readily be added in order to pick up rejection of even higher harmonics. The disclosed harmonic filter offers a low-cost, ultra-high multipaction threshold solution. The disclosed solution uses a hybrid-ridge guide that is quite easy to fabricate via split block manufacturing, as described in more detail herein.

The filter of the subject technology includes corrugations that are joined by an identical cross-section, hybrid-ridge waveguide section that provides strong rejection of transverse electrical (TE)n0 modes even in the presence of pure TEn0 exciters. Broad rejection bands can be achieved along with a broad passband. Because all hybrid sections of the filter are identical, the filter can be readily manufactured via a single pass wire electrical-discharge machining (EDM) at a low cost.

The disclosed hybrid-ridge waveguide sections include slopes to deflect electrons away from the high-voltage region, thereby greatly increasing power handling. Also, the hybrid-ridge waveguide section contains no ridge on the zero-current region of the waveguides, thereby mitigating contact pressure risk and minimizing sensitivity to tolerance variation. Furthermore, the peak voltage no longer occurs in the filter center and is split between neighboring symmetrically positioned ridges, thereby increasing power handling of the disclosed filter.

Figure 1:
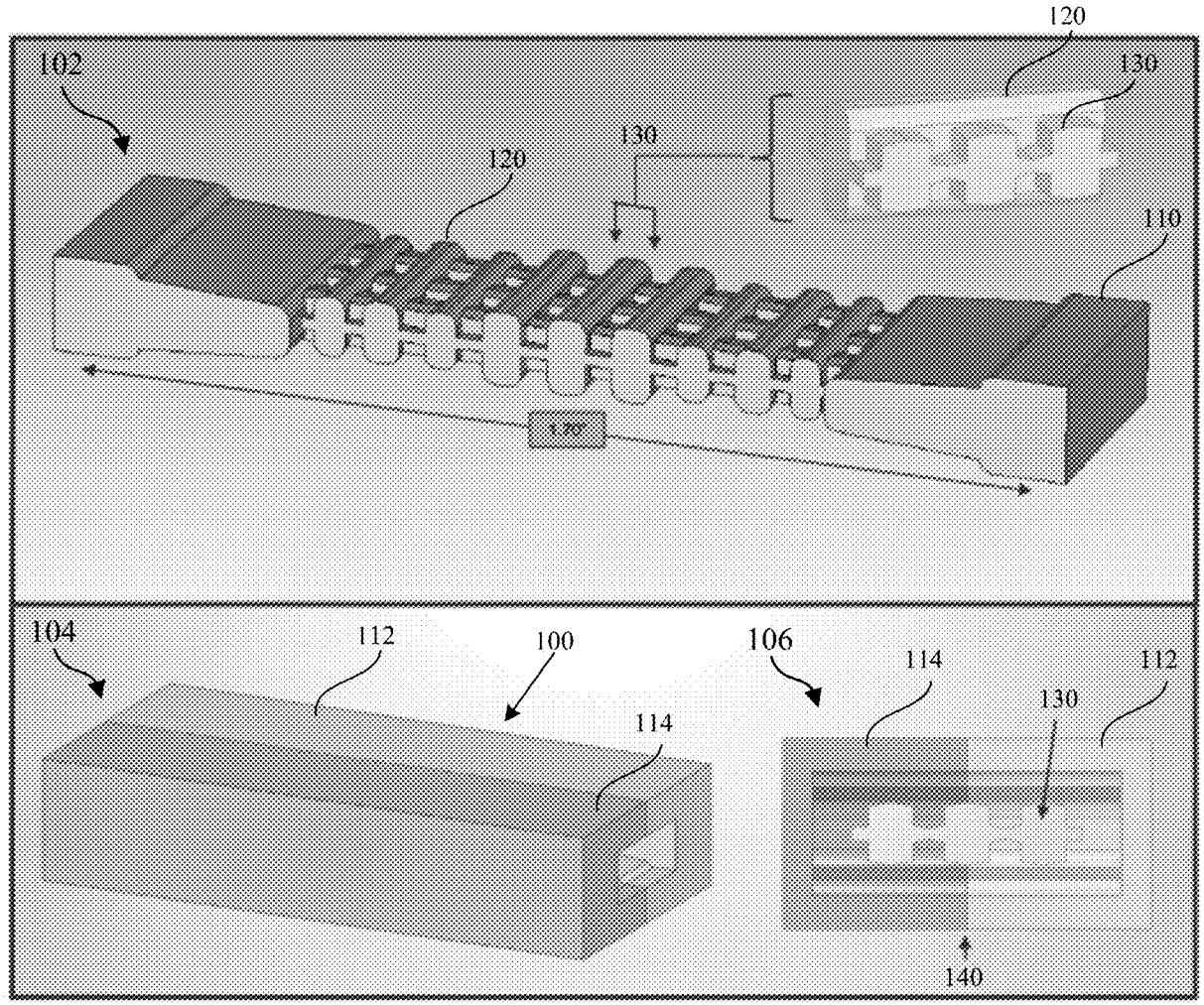
FIG. 1 is a schematic diagram illustrating an air-cavity view and fabricated views of an example of a high-power hybrid-harmonic filter, according to certain aspects of the disclosure.

FIG. 1 is a schematic diagram illustrating an air-cavity view 102 and fabricated-views 104 and 106 of an example of a high-power hybrid-harmonic filter 100, according to certain aspects of the disclosure. The air-cavity view 102 shows shaped transformer sections 110 on both ends of a waveguide, including a number of corrugations 120 and shaped hybrid-ridge interconnects 130 (hereinafter, ridge interconnects 130), which together form a cavity of an example high-power hybrid-harmonic filter 100 (hereinafter, harmonic filter 100) of the subject technology. The air-cavity view 102 is depicted in FIG. 1 having a length of 1.70 inches. The ridge interconnects 130 are important features of the disclosed harmonic filter that are responsible for improved power handling and TEn0 mode rejection of the harmonic filter. The transformer sections 110 contain slopes into a truncated first hybrid-ridge waveguide section that further increases power handling and enables a broad well-matched passband. The transformer sections 110 do not produce impedance step-up as is seen in traditional filters, and rather archives impedance step-down into the adjacent (terminal) shaped hybrid ridge.

The harmonic filter 100 of the subject technology is formed via different-height corrugations 120 joined by identical cross-section ridge interconnects 130, which run through the entire filter assembly, and is fully accessible from both ends of the filter, thereby enabling innovative ridge shaping via single-pass wire EDM. As depicted in FIG. 1, the corrugations have varying heights along the length of the harmonic filter 100, where the heights of the corrugations increase toward a mid-length of the harmonic filter 100. The ridge interconnects 130 contain no ridge features on the filter centerline that enables a split plane down the zero-current region of the waveguide. A robust pressure lip can be achieved with no thin-contact features. Furthermore, the peak voltage would be split between two shaped ridges, which improves power handling. The ridge interconnects 130 not only fully reject TEn0 modes over broad bandwidths but also increase power handling over about 300 times that of the traditional waffle filter.

The fabricated-view 104 shows a perspective view of the harmonic filter 100 after fabrication. The cavity inside the harmonic filter 100 has the configuration shown by the air-cavity view 102, discussed above. The harmonic filter 100 is formed by connecting two identical half-sections 112 and 114.

The fabricated-view 106 shows a cross-sectional view of the harmonic filter 100 and the structure of the ridge interconnects 130. Further shown in the fabricated-view 106 is a zero-current region 140 of the waveguide. The fact that no ridge exists in the center region of the waveguide unlocks zero-current split-plane possibility, increases power handling and offers strong TEn0 mode rejection even in the presence of TEn0 exciters.

Figure 2A:
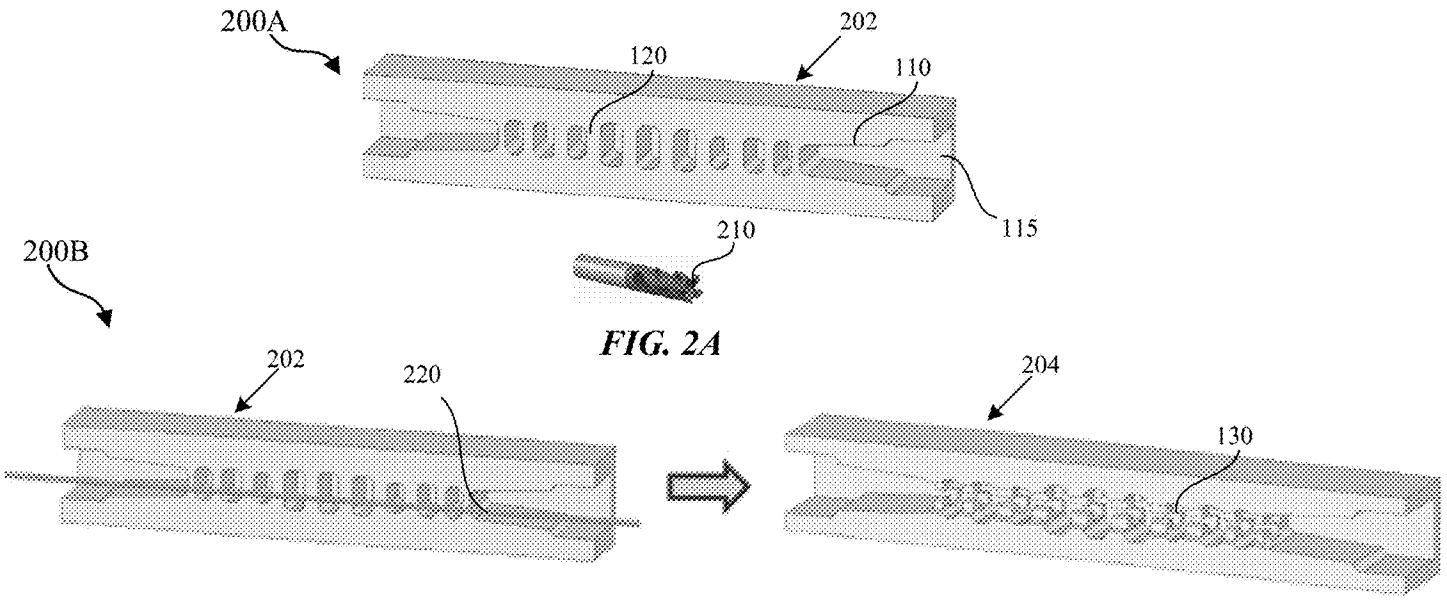
FIGS. 2A, 2B and 2C are schematic diagrams illustrating manufacturing steps and cross-sectional views of an example of a high-power hybrid-harmonic filter, according to certain aspects of the disclosure.
Figure 2B:
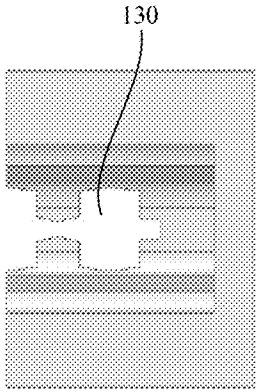
Figure 2C:
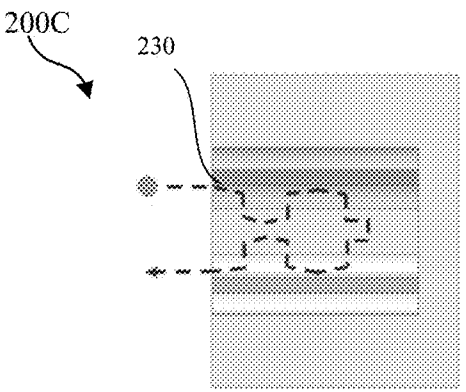

FIGS. 2A, 2B and 2C are schematic diagrams illustrating manufacturing steps 200A (FIG. 2A) and 200B (FIG. 2B) and cross-sectional views 200C (FIG. 2C) of an example of a harmonic filter, according to certain aspects of the disclosure. In the first manufacturing step 200A, an initial first half-section 202 can be fabricated by direct machining of corrugations 120, sloped transformers 110 and waveguide ports 115 by using, for example, a machine tool 210. Further, sinker EDM can also be used to achieve improved surface finish at Ka band (18-27 GHz) and higher frequencies. The second half-section of the harmonic filter is identical to the first half-section, except that it may include a pressure lip to ensure good contact pressure.

In the second manufacturing steps 200B, wire EDM of the shaped hybrid ridge interconnects is performed by using an EDM wire 220, which can be pulled through the filter half-section, to form the ridge interconnects 130 in the initial first half-section 202 to form the complete first half-section 204. The second half-section is similarly manufactured.

The cross-sectional views 200C show the EDM wire-cutting path 230, where the EDM wire 220 (FIG. 2B) travels to create the ridge interconnects 130 and the result of the EDM wire-cutting operation creating the ridge interconnects 130.

Figure 3:
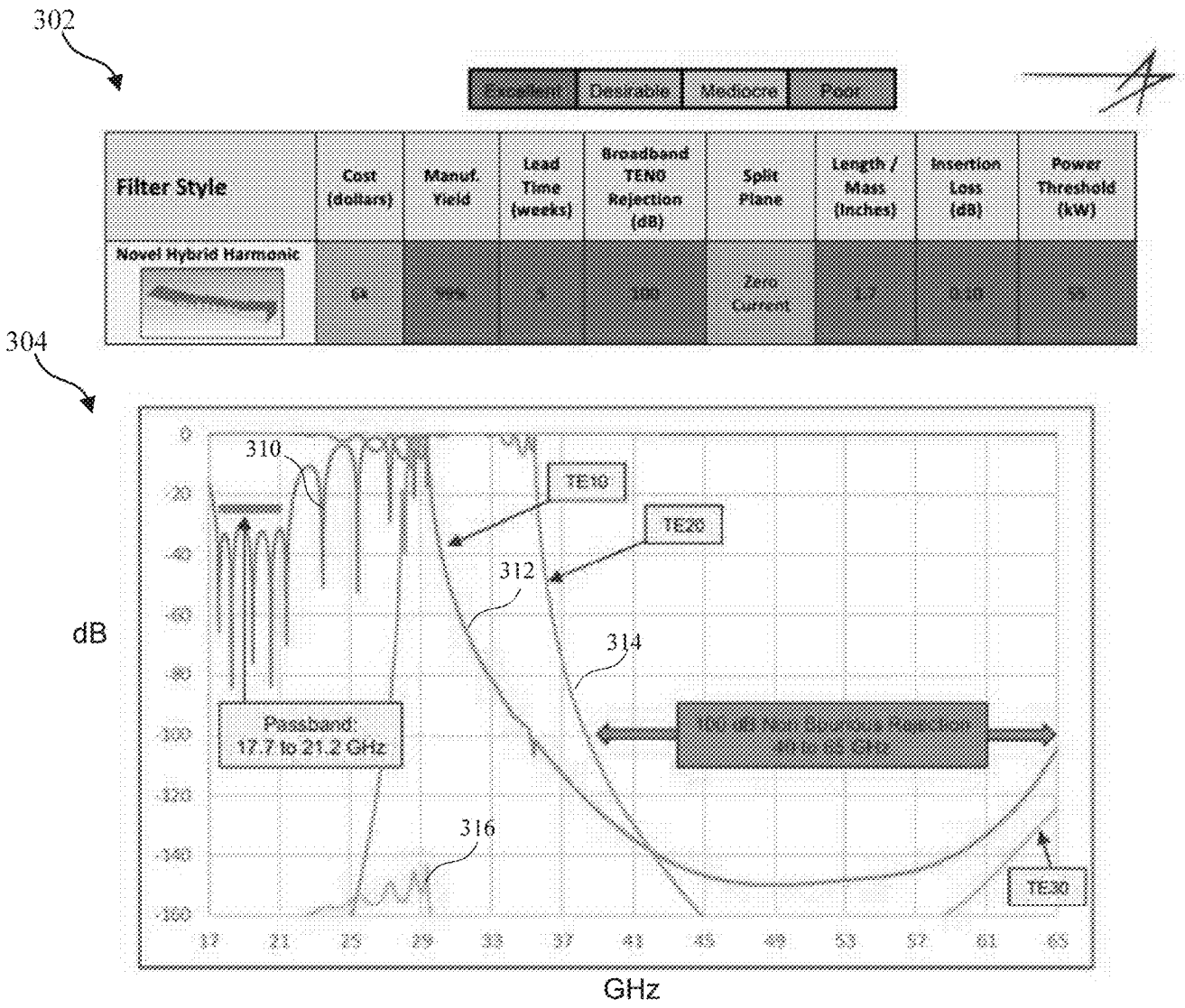
FIG. 3 illustrates charts showing manufacturing, physical, and functional parameters and performance characteristics of an example of a high-power hybrid-harmonic filter, according to certain aspects of the disclosure.

FIG. 3 illustrates charts 302 and 304 showing manufacturing, physical, and functional parameters and performance characteristics of an example of a high-power hybrid-harmonic filter, according to certain aspects of the disclosure. The chart 302 provides example values of a number of manufacturing parameters, such as cost (e.g., 6,000 dollars), yield (e.g., 99%), and lead time (e.g., 5 weeks), that are shown to be at an excellent or desirable level. Also, functional parameters, such as broadband TEn0 rejection (e.g., 100 dB), insertion loss (e.g, 0.10 dB) and power threshold (e.g., 55 kW), are at an excellent level. Further, the physical parameters, including the split plane being at zero current and the length and/or mass values (e.g, 1.7 inches) are similarly at the desirable or excellent levels.

The chart 304 depicts plots 310, 312, 314 and 316. The plot 310 shows that passband rejection is within the range of 17.7 GHz to 21.2 GHz. Plots 312, 314 and 316 depict rejection of TE10, TE20 and TE30 modes, respectively, showing strong rejection of TEn0 modes (e.g., 100 dB non spurious rejection) over a broad bandwidth (e.g., 40 GHz to 65 GHz) while handling high power by the shaped hybrid-ridge filter of the subject technology. The power handling of the disclosed shaped hybrid-ridge filter can exceed several hundred (e.g., 300) times that of a traditional waffle filter.

Figure 4A:
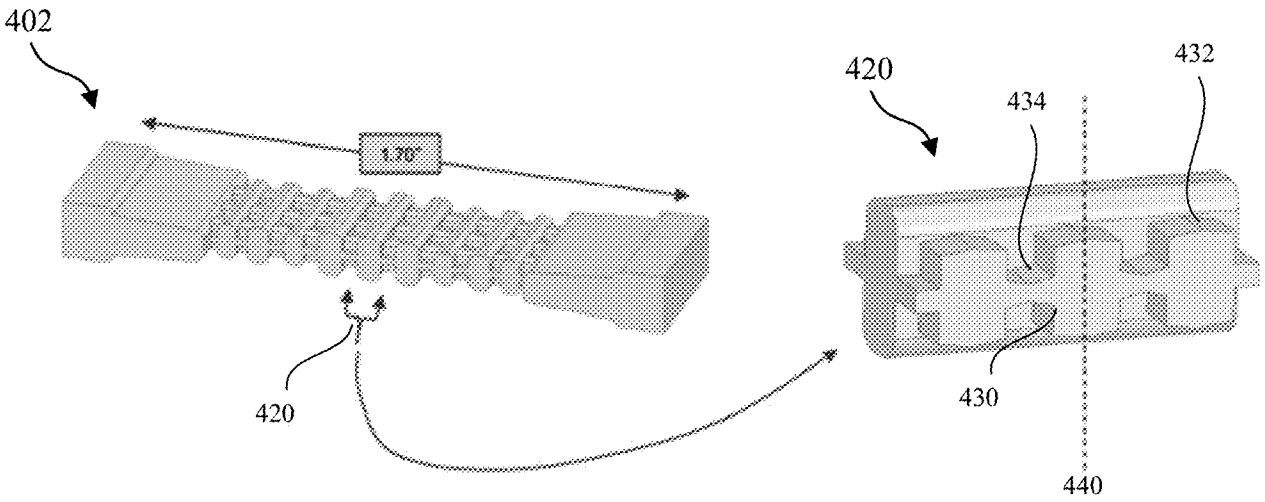
FIGS. 4A and 4B are schematic diagrams illustrating air-cavity views and a cross-sectional view of an example of a high-power hybrid-harmonic filter, according to certain aspects of the disclosure.
Figure 4B:
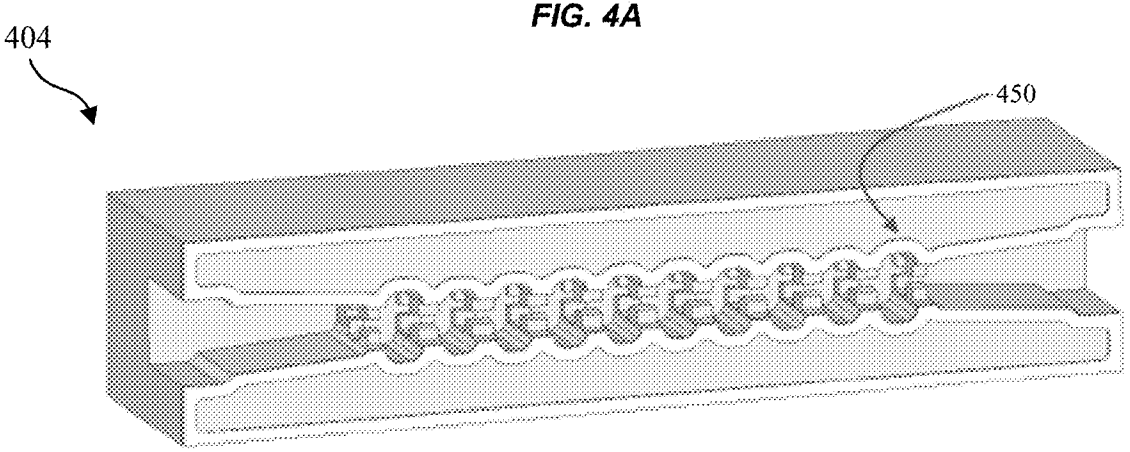

FIGS. 4A and 4B are schematic diagrams illustrating air-cavity views 402 and 420 (FIG. 4A) and a cross-sectional view 404 (FIG. 4B) of an example of a high-power hybrid-harmonic filter, according to certain aspects of the disclosure. The air-cavity view 402 is similar to the air-cavity view 102 of FIG. 1 and has a length of about 1.7 inches, as shown in FIG. 4A. A ridge-portion 420 of the air-cavity view 402 is shown in a magnified view, which includes ridge interconnects 430 and shows a line 440 indicating enablement of zero-current split plane by placing no ridge in the waveguide center, as shown in FIG. 4A. It should be noted that peaks 432 and valleys 434 of the air cavity shown in FIG. 4A correspond to valleys and ridges in the actual manufactured filter. Therefore the waveguide center denoted by line 440 passes through a valley in the actual manufactured filter and not a ridge.

The cross-sectional view 404 shows a half-section of the high-power hybrid-harmonic filter of the subject technology depicting a pressure-lip 450 (FIG. 4B), which is a robust high-pressure lip having no thin peninsulas to ensure safe contact pressure, thus reducing an associated risk in the manufacturing process.

Figure 5:
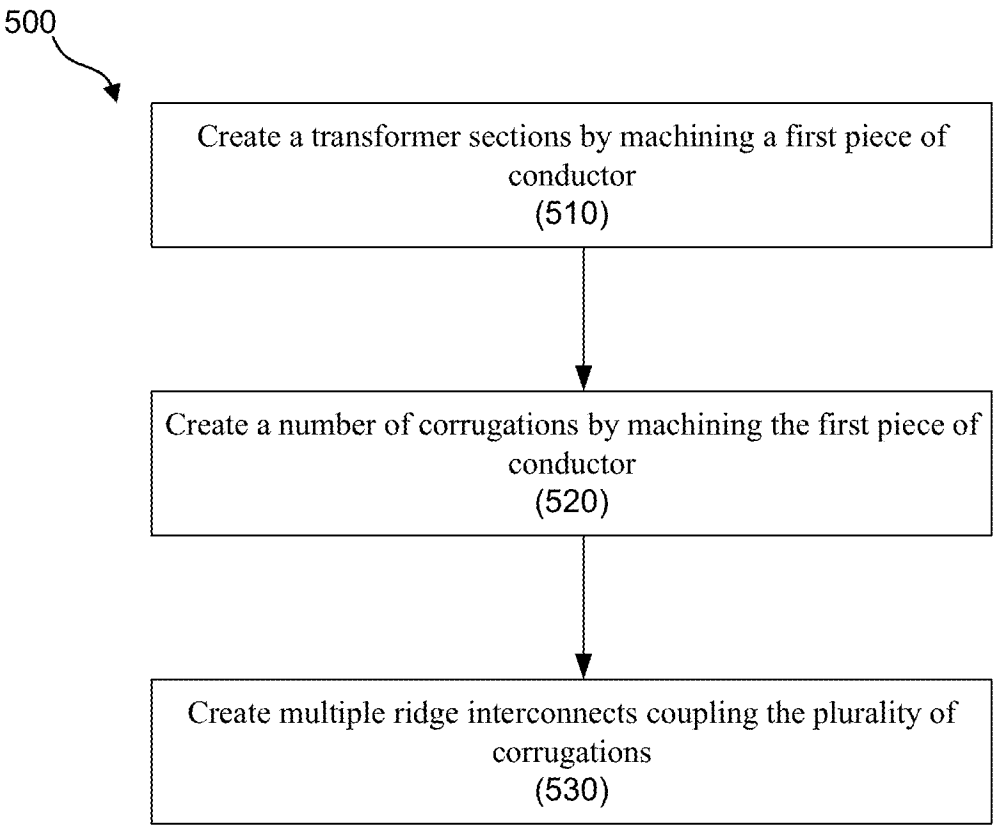
FIG. 5 is a flow diagram illustrating an example of a method of producing a high-power hybrid-harmonic filter, according to certain aspects of the disclosure.

FIG. 5 is a flow diagram illustrating an example of a method 500 of producing a high-power hybrid-harmonic filter (e.g., 104 of FIG. 1), according to certain aspects of the disclosure. The method 500 includes creating transformer sections (e.g., 110 of FIG. 1) by machining a first piece of conductor (510) and creating a number of corrugations (e.g., 120 of FIG. 1) (520) and multiple ridge interconnects (e.g., 130 of FIG. 1), coupling the corrugations (530). The transformer sections are created end terminals of the waveguide filter, and the corrugations are created along a length of the waveguide filter. The transformer sections, the corrugations and the ridge interconnects form a first half-section air cavity (e.g., 102 of FIG. 1). A second half-section air cavity similar to the first half-section air cavity may be created by machining a second piece of conductor. The first piece of conductor and the second piece of conductor may be made of a metal such as aluminum. The surfaces of the first half-section air cavity and the second half-section air cavity may be plated with a highly conductive metal such as gold, silver, or copper.

In some aspects, the subject technology is related to communication systems and, more particularly, to high-power hybrid-harmonic filter. In some aspects, the subject technology may be used in various markets, including, for example, and without limitation, the communication systems markets.

Those of skill in the art would appreciate that the various illustrative blocks, modules, elements, components, methods, and algorithms described herein may be implemented as electronic hardware, computer software or a combination of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order or partitioned in a different way), all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks may be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single hardware and software product or packaged into multiple hardware and software products.

The description of the subject technology is provided to enable any person skilled in the art to practice the various aspects described herein. While the subject technology has been particularly described with reference to the various figures and aspects, it should be understood that these figures and aspects are for illustration purposes only and should not be taken as limiting the scope of the subject technology.

A reference to an element in the singular is not intended to mean "one and only one" unless specifically stated, but rather "one or more." The term "some" refers to one or more. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified, and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range is specifically disclosed. Also, the terms in the claims have their plain, ordinary meanings unless otherwise explicitly and clearly defined by the patentee. If there is any conflict in the usage of a word or term in this specification and one or more patents or other documents that may be incorporated herein by reference, the definition that is consistent with this specification should be adopted.

What is claimed is:

1. A hybrid-harmonic waveguide filter, the waveguide filter comprising:

transformer sections at end terminals of the waveguide filter;

a plurality of corrugations along a length of the waveguide filter; and a plurality of ridge interconnects configured to couple the plurality of corrugations, wherein:

the plurality of ridge interconnects comprise shaped hybrid-ridge interconnects, and the transformer sections comprise respective sloped air cavities between corresponding ports of the waveguide filter and the plurality of ridge interconnects coupling end corrugations of the waveguide filter to the transformer sections.

2. The waveguide filter of claim 1, wherein the plurality of ridge interconnects are configured to couple terminal corrugations of the waveguide filter to the transformer sections.

3. The waveguide filter of claim 1, wherein the transformer sections, the plurality of corrugations and the plurality of ridge interconnects are configured to reject traverse electrical (TE)n0 modes over a broad bandwidth.

4. The waveguide filter of claim 1, wherein the respective sloped air cavities between corresponding ports of the waveguide filter and the plurality of ridge interconnects are configured to achieve impedance step-down into terminal shaped hybrid ridges.

5. The waveguide filter of claim 1, wherein the plurality of corrugations has varying heights along the length of the waveguide filter.

6. The waveguide filter of claim 5, wherein the varying heights of the plurality of corrugations increase toward a mid-length of the waveguide filter.

7. The waveguide filter of claim 1, wherein each shaped hybrid-ridge interconnect of the plurality of ridge interconnects comprises an air cavity including multiple peaks and valleys along a length of a corrugation of the plurality of corrugations.

8. The waveguide filter of claim 1, wherein each shaped hybrid-ridge interconnect of the plurality of ridge interconnects comprises no ridge in a center plane of the waveguide filter to enable creation of a zero-current split plane.

9. The waveguide filter of claim 8, wherein the plurality of ridge interconnects includes two ridges on sides of the center plane of the waveguide filter.

10. The waveguide filter of claim 8, further comprising a contact pressure lip configured to ensure a safe contact pressure that reduces associated risk in a manufacturing process.

11. An apparatus comprising:

two transformer sections at two ends of the apparatus;

a plurality of corrugations disposed along a length of the apparatus; and a plurality of ridge interconnects disposed to couple the plurality of corrugations wherein:

each ridge interconnect of the plurality of ridge interconnects comprises a respective shaped hybrid-ridge interconnect created along a corresponding corrugation of the plurality of corrugations, and the two transformer sections comprise respective sloped air cavities between corresponding ports of the apparatus and the plurality of ridge interconnects coupling end corrugations of the apparatus to the transformer sections.

12. The apparatus of claim 11, wherein:

the two transformer sections, the plurality of corrugations and the plurality of ridge interconnects comprise a hybrid waveguide filter and are configured to reject TEn0 modes over a broad bandwidth, the apparatus further comprises a contact pressure lip configured to ensure a safe contact pressure that reduces an associated risk in a manufacturing process, and each shaped hybrid-ridge interconnect of the plurality of ridge interconnects comprises no ridge in a center plane of the hybrid waveguide filter to enable creation of a zero-current split plane.

13. A method of providing a hybrid waveguide filter, the method comprising:

creating transformer sections by machining a first piece of conductor;

creating a plurality of corrugations by machining the first piece of conductor; and creating a plurality of ridge interconnects coupling the plurality of corrugations, wherein:

the transformer sections are end terminals of the hybrid waveguide filter, the plurality of corrugations are created along a length of the hybrid waveguide filter, and the transformer sections, the plurality of corrugations and the plurality of ridge interconnects form a first half-section air cavity.

14. The method of claim 13, further comprising creating a second half-section air cavity by machining a second piece of conductor.

15. The method of claim 14, further comprising creating pressure lips along the first half-section air cavity and the second half-section air cavity to produce first and second half-section waveguide filters.

16. The method of claim 15, wherein the first piece of conductor and the second piece of conductor are made of a metal comprising aluminum, and wherein surfaces of the first half-section air cavity and the second half-section air cavity are plated with a highly conductive metal including gold, silver or copper.

17. The method of claim 15, further comprising joining the first and second half-section waveguide filters to form the hybrid waveguide filter.

18. The method of claim 15, wherein creating the plurality of ridge interconnects does not produce a ridge in a center plane of the hybrid waveguide filter.

19. The method of claim 13, wherein creating the plurality of ridge interconnects comprises using a single-pass wire electrical-discharge machining (EDM).

* * * * *